US007650670B2

(12) United States Patent
Baer et al.

(10) Patent No.: US 7,650,670 B2
(45) Date of Patent: Jan. 26, 2010

(54) HINGE ATTACHMENT SYSTEM AND METHOD

(75) Inventors: Austin R. Baer, 7311 Proctor Rd., Sarasota, FL (US) 43241; Kerry B. Sprick, Houston, TX (US)

(73) Assignee: Austin R. Baer, Sarasota, FL (US)

( * ) Notice: Subject to any disclaimer, the term of this patent is extended or adjusted under 35 U.S.C. 154(b) by 562 days.

(21) Appl. No.: 11/628,624

(22) PCT Filed: Jun. 10, 2005

(86) PCT No.: PCT/US2005/020527

§ 371 (c)(1), (2), (4) Date: Dec. 5, 2006

(87) PCT Pub. No.: WO2005/124078

PCT Pub. Date: Dec. 29, 2005

(65) Prior Publication Data

US 2007/0261201 A1 Nov. 15, 2007

Related U.S. Application Data

(60) Provisional application No. 60/578,891, filed on Jun. 10, 2004.

(51) Int. Cl.
*E05D 7/06* (2006.01)

(52) U.S. Cl. ..... 16/236; 29/464; 29/434

(58) Field of Classification Search ..... 16/235, 16/236, 238, 354; 29/434, 464; 49/501; 52/213, 455

See application file for complete search history.

(56) References Cited

U.S. PATENT DOCUMENTS

| | | | | |
|---|---|---|---|---|
| 1,346,029 | A | | 7/1920 | Hubbard |
| 2,615,194 | A | | 10/1952 | Kreiner |
| 2,885,722 | A | | 5/1959 | Halliday |
| 4,104,762 | A | | 8/1978 | Rock |
| 4,307,865 | A | | 12/1981 | MacCready |
| 4,407,044 | A | | 10/1983 | Iseki |
| 4,861,099 | A | * | 8/1989 | Sasamura et al. ..... 296/202 |
| 4,864,688 | A | | 9/1989 | Gerber |
| 5,144,721 | A | | 9/1992 | Schade |
| 5,327,684 | A | | 7/1994 | Herbst |

(Continued)

*Primary Examiner*—Chuck Y. Mah
(74) *Attorney, Agent, or Firm*—Duane Morris LLP; Frank J. Spanitz

(57) ABSTRACT

A hinge including leaves configured to facilitate adjusting the mounting position between hinged objects. In one embodiment, the hinge may generally include first and second leaves pivotally connected together. The leaves define mounting holes that receive fasteners to mount the leaves to the hinged objects. The mounting holes are preferably configured to provide adjustment of the leaves and hinged objects in at least two directions, which may be horizontal and vertical. In one embodiment, the hole shapes preferably may include horizontal slots, vertical slots, round holes, and combinations thereof. Other shapes may be used. When a fastener is partially inserted into a hinged object through a slotted-type mounting hole, for example, the hinged object is slideable relative to the leaf and the other hinged object. By employing a preferred sequence of installation steps, the installer may readily optimize the alignment between and mounting of the hinged objects. In one embodiment, the hinged objects may be a door and a door frame. A method of installation using the specially-configured leaves is also provided.

18 Claims, 12 Drawing Sheets

U.S. PATENT DOCUMENTS

| | | | | |
|---|---|---|---|---|
| 5,375,296 | A | 12/1994 | Zaleskie | |
| 5,685,045 | A | 11/1997 | Lace | |
| 5,778,491 | A | 7/1998 | Baer | |
| 5,991,975 | A | 11/1999 | Baer | |
| 6,145,164 | A | 11/2000 | Ferrari | |
| 6,286,185 | B1 * | 9/2001 | Ramsauer | 16/236 |
| 6,732,409 | B2 * | 5/2004 | Baer | 16/354 |
| 6,792,661 | B1 * | 9/2004 | Fromme et al. | 29/416 |
| 6,928,713 | B2 * | 8/2005 | Baer | 29/434 |
| 2004/0123425 | A1 * | 7/2004 | Almestad | 16/236 |

* cited by examiner

HINGE ATTACHMENT SYSTEM AND METHOD

CROSS-REFERENCE RELATED APPLICATIONS

The present application is a U.S. National Phase Application of International Application PCT/2005/020527 (filed Jun. 10, 2005) which claims the benefit of U.S. Provisional Application No. 60/578,891 (filed Jun. 10, 2004), all of which are herein incorporated by reference in their entirety.

BACKGROUND OF THE INVENTION

The present invention relates to hinges, and more particularly to continuous hinges and methods to align and adjust hinged objects for optimal clearance and operation.

When a hinge is mounted to objects to be hinged with respect to each other, care must be taken to ensure proper alignment and mounting of the hinge and hinged objects. Doors that are in need of repair are often retrofitted with various types of hinges that are known for their increased strength among other factors. Hinges that are applied in the field are often installed under less than ideal conditions. To complete a quality field installation of a door, for example, the door must be maintained in proper alignment with the frame, requiring a prescribed set of clearances at each side of the door and at its top and bottom edges. If this is not done, the door may potentially rub against the frame or drag on the threshold, increasing the difficulty for persons entering or leaving the building as well as imposing additional stress and wear on all of the door hardware, such as locksets and automatic door closers.

Uniform industry standards for the design of butt hinges have been applied to doors and frames in the form of cutouts, or receiving mortises, that allow butt hinges to be fastened directly into these recesses. However, not all of the door alignment requirements are assured when the doors and frames are manufactured. Sometimes, particularly if the doors and frames arrive at the job site from different manufacturing sources, the cutouts or recesses may not correspond, creating misalignment problems that can affect the operating clearances. Also, the installation of frames can be affected by improperly dimensioned or misaligned wall openings, resulting in frame distortion that contributes to door misalignment.

To install continuous hinges such as disclosed in my U.S. Pat. Nos. 3,092,870; 3,402,422; 4,976,008; 4,996,739; 4,999,878; 4,999,879; 4,999,880; 5,001,810; 5,201,902; 5,778,491 and 5,991,975, all of which are incorporated herein by reference, the installer typically must carefully remove the damaged hinges and mark and drill for the new fastener locations on both the door and the frame as best possible. This especially pertains to those types of hinges that are applied to the exterior faces of doors and frames when they are in need of hinge replacement. All too often, when transferring the new screw hole locations from the continuous hinge to the door and frame, the hinge can shift, or the drill point can slide from the mark, contributing to poor door alignment when the installation is complete. Such fastener hole misplacements occur with even greater frequency when large holes are required for through-bolting, especially when hidden internal door reinforcements are encountered by the installer.

Hinges that are continuous (i.e., hinges that attach a door to its frame or to another door for a substantial part of the length of the joined portions) may take various forms, including hinges which are formed from sheet metal by stamping and curling "knuckles", or essentially cylindrical receptacles, along the length of a strip which will accept a longitudinal pin, wire or rod. The knuckles are separated by spaces of generally equal length so that the opposing knuckles of a second hinge member may be interposed between the knuckles of the first hinge member and joined by the pin, wire or rod. Such hinges are commonly known as "piano" hinges, and are used, in addition to pivoting the covers for piano keyboards, for building athletic lockers, furniture, equipment enclosures and for building architectural doors and frames, or wherever a secure hinging system is required. My U.S. Pat. No. 5,991,975, which is incorporated herein by reference, describes a hinge of this type, which has been improved by a variety of means to mechanically articulate a covering member to enhance its appearance as well as to improve its protection from environmental deterioration and other hazards.

Another form of continuous hinge, described in my U.S. Pat. No. 3,402,422, which is incorporated herein by reference, teaches a continuous hinge with two hinge members rotatably mounted about the edges of a C-shaped, elongated clamp that defines an internal channel. Gear segments at the edges of the hinge members are meshed with each other to pivotally connect the hinge members. One or more thrust bearings disposed in recesses of both hinge members prevent relative movement of the hinge members along their axes of rotation. The bearings occupy most of the cross-sectional spaces within the clamp and have bearing surfaces on their ends that are generally parallel to, abut, and support the recess end surfaces of the hinge member recesses. Another configuration of a continuous hinge is taught in my U.S. Pat. No. 4,999,879, which is incorporated herein by reference, that discloses hinge members with gear segments meshed with the clamp instead of, or in addition to, being meshed with each other.

Butt hinges as well as continuous hinges can be improved by providing alignment flexibility when attaching the hinges so that the door will have adequate clearance within its frame or other surrounding enclosure. One of the more difficult steps in continuous hinge or butt hinge installation in the field is the proper sizing of the door and frame in relation to each other and the proper marking and preparation of the fastener holes in a way which will insure the alignment of the door to its frame when the installation is complete. Currently, the installation of continuous hinges is dependent upon the skills of the individual installer. While individual butt or mortise hinges are typically fitted into cutouts with pre-threaded bolt holes prepared in both the door and the frame at their respective factories, discrepancies in manufacturing tolerances and machinery often result in doors that do not provide acceptable clearances. When this occurs, the aesthetics may suffer, weather or sound sealing may be inadequate, or the door and frame may actually interfere with each other as the door is cycled. The fixed locations of butt hinge screw attachments may actually inhibit proper positional adjustment of the door.

Continuous hinges are more frequently applied to the unprepared surfaces of doors and frames which offer little to assist in their alignment. Repair work in particular, where continuous hinges are used to overcome conditions in which conventional hinges have failed, is more dependent upon the skill level of the installer because the working environment as well as the condition of the door and frame components may be less than ideal, largely because the doors themselves may have suffered damage when their hinges failed and because the work must often be completed very quickly with a minimum of installation tools. Unless all of the fastener locations for a continuous hinge are carefully marked and drilled, the door will interfere with or rub against the frame following installation or shortly thereafter.

A method of marking, adjusting and positioning the height of a door and the tools for accomplishing a simplified continuous hinge installation is disclosed in my invention disclosed in U.S. Pat. No. 6,732,409, which is incorporated herein by reference, in which a continuous hinge is mounted to a rail which has been aligned and affixed to the hinged object using tools and methods that allow for the vertical adjustment of the hinged object during or after the installation.

Despite the improvements that the aforementioned teachings provide, there still remains further need for an improved hinge and method of installation to provide even greater flexibility and ease in adjusting a door to properly align it with its frame under a wide variety of frame and door conditions encountered in the field. There is a further need for an improved hinge and method of installation that reduces reliance on the skills of the installer to allow installers of various skill levels to properly align and hang a door.

BRIEF SUMMARY OF THE INVENTION

The present invention extends the adjustment range of the door by providing for lateral or horizontal as well as vertical or longitudinal positioning of the door during installation. A methodical sequence of installation steps for the installation of the improved continuous hinge is provided. While the principal application of hinges for retrofit work and for this invention favors continuous hinges because it can be assumed that the strength of a continuous hinge would find favor if another hinge type had failed at that location, similar techniques will apply to butt hinges. One familiar with general hinge construction will find that this invention applies equally well to continuous and butt hinge products.

A further advantage of the invention is to allow a continuous hinge of the type described to be installed on a hinged object, which in a preferred embodiment is an architectural door, without extensive or accurate pre-positioning of the hinged object. It is common knowledge in the industry that such doors, which may be exterior and interior access doors, are typically at least 6½ feet in height with the vertical door frame jamb having a height approximately equal to or slighter higher than the door. It is another advantage of this invention to allow doors of virtually any weight and size to be safely and conveniently installed by permitting the attachment of the continuous hinge to the door and its frame while the door is resting on its threshold. Following the insertion of a sufficient number of fasteners to insure that the door is secured in the plane of the opening, the door may then be lifted vertically and adjusted laterally into its final operating position with accuracy and in complete safety. Yet another advantage of the invention is that allows installers of various skill levels to achieve a properly aligned and hung door.

In certain configurations of hinges, particularly those which have one hinge leaf mounted in the plane of the door and attached to the face of the door with the other leaf positioned perpendicular to the plane of the door and attached to the rabbet or jamb of the frame, this invention provides for vertical door adjustment, lateral adjustment in the plane of the door and adjustment of the inset of the door with respect to the plane of the frame or wall in a direction perpendicular to the plane of the wall. It will be understood that with such hinges, known in the industry as half-surface hinges which form a right angle when the door is in its closed position, one leaf could alternatively be attached to the face of the frame while the other leaf is attached to the door edge to achieve the same three-way adjustment capability.

Yet another advantage of the present invention is that a new or existing door may be installed while it remains in its closed position. This means that temporary barriers (for security or weather) and the door itself may be left in place during installation, allowing rapid completion of the installation. Or, the installation may be interrupted or postponed without consequence.

The present invention is generally directed to a hinge with first and second hinge members pivotally connected together. At least one of these hinge members may be provided with a variety of mounting hole types designed to accept one or more fasteners to connect the hinged member to a hinged object.

The first type of mounting hole may be a conventional round hole designed to accept a bolt, sheet metal screw or through-bolt which may be equipped with a wide variety of head styles, which could also include under-head surfaces to prevent rotation, especially in the case of fasteners which are intended for tightening from the surface of the hinged object opposite from the surface which forms the interface between the hinged member and the hinged object, such as a "carriage" bolt or through-bolt. Such fasteners may advantageously prevent rotation between the bolt and the surface-mounted hinge member. While such fasteners may be used with this invention, they are not required for an effective installation. In a preferred embodiment, self-drilling screws may be used.

The second type of mounting hole used in one or both of the hinged members (and it will be understood that certain types of hinges, particularly those which are used to hang two or more doors from a central post, may have more than two hinged members) may be a substantially vertical or longitudinal slot in one or more locations on one or more of the hinged members.

The third type of hole may be a substantially horizontal or lateral slot disposed in the same manner. It will be further understood that each of these slots may be interspersed in a variety of ways along the length of one or all of the hinged members in a manner best suited to the design of the hinge, its load-carrying requirements and to other parameters related to the design and construction of the hinged object.

In a preferred embodiment, the hinge member that will be mounted to a movable hinged object (such as a door, for example) may be provided with the above combination of conventional round holes and slotted holes. The second hinge member that may be mounted to a fixed object (such as a door frame, for example) may include all round holes. Alternatively, the second hinge member may also include a combination of round and slotted holes if desired which may be particularly advantageous where the second hinge member will be attached to another door. It will be appreciated that embodiments are possible using more than two hinge members where multiple doors are to be pivotally connected together such as in a bi-fold or tri-fold door installation.

It will be further understood that the design and of each of the three hole types described above may be combined (as in an "L" shaped hole that combines the vertical and horizontal orientation of each hole type as a single perforation of the hinged member at one or more locations) and that other variations of the hole shapes and patterns, including sloping, arcuate and other hole shapes and shape combinations that allow fasteners to be located anywhere within a given hole outline are embodied in this concept and that the number and types of holes described herein may be more or less than three.

In a preferred embodiment, the fasteners for use in the slotted holes may be equipped with a smooth, larger diameter shank portion directly under the head to facilitate the sliding motion which may be required during lateral or vertical adjustment, avoiding the increased resistant to such motion if the weight of the door were to rest on the threaded portion of the fasteners. Alternatively, and to accomplish the same result, the fasteners could be equipped with a short bushing or ferrule (sleeve) to present a smooth surface to contact the walls of the slot.

Continuous hinges which include the adjustment features of this invention could advantageously be equipped with protective and ornamental moldings to conceal otherwise exposed mounting fasteners, or alternatively may be supplied with a variety of security fasteners manufactured with vandalresistant heads to deter fastener removal or any change in door positioning after the installation is complete.

The preferred embodiments will be further described in detail below with specific reference to the drawings provided herewith.

BRIEF DESCRIPTION OF THE DRAWINGS

The features and advantages of the preferred embodiment will be described with reference to the following drawings that form part of the specification and in which like elements are labeled similarly, and in which.

DETAILED DESCRIPTION OF THE PREFERRED EMBODIMENTS

It should be recognized that while a hinge mounting system is described and illustrated with reference to particular preferred embodiments, the scope of the invention is not intended to be limited to such embodiments. Furthermore, the description of the preferred embodiments that follow, and any references to orientation, configuration, direction, size, or materials, is intended primarily for convenience and does not limit the scope of the present invention in any way.

Figure 2:
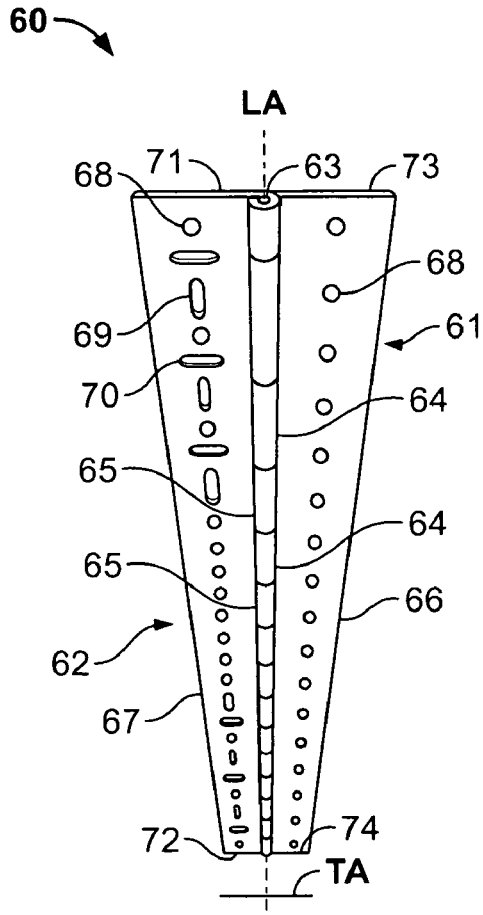
FIG. 2 is a perspective view of the hinge of FIG. 1.

The longitudinal direction is herein defined as extending in a direction generally parallel to the longitudinal axis LA along the length of the hinge, as shown in FIG. 2. The transverse direction is defined herein as extending in a direction generally perpendicular to the longitudinal axis LA, along the transverse axis TA also as shown in FIG. 2.

Figure 1:
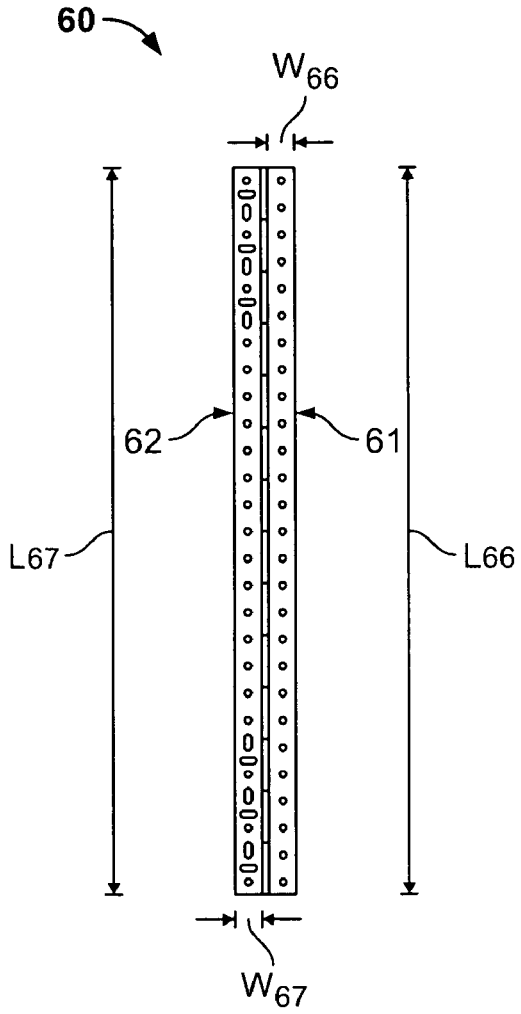
FIG. 1 is a plan view of one embodiment of a hinge having a vertically and horizontally adjustable hinge member.

Referring to FIGS. 1 & 2, there is shown a conventional longitudinally-extending pin and knuckle or barrel hinge 60 having two hinge members 61, 62 pivotally connected by pin 63. Pin 63 extends through interspersed knuckles 64, 65 formed on each of the hinge members 61, 62, respectively. Knuckles 64, 65 each define a longitudinal opening therethrough that may be concentrically aligned when hinge members 61, 62 are connected to receive pin 63. Hinge members 61, 62 further include leaves 66, 67 respectively, which are attached to knuckles 64, 65. Leaves 66, 67 are used to mount hinge members 61, 62 to hinged objects. Leaf 66 includes two opposite ends 73, 74, and has a length $L_{66}$ and a width $W_{66}$. Leaf 67 includes two opposite ends 71, 72, and has a length $L_{67}$ and a width $W_{67}$.

Hinge 60 is suitable for continuous hinge applications in which the hinge members extend for substantially, but not necessarily all of the entire length of the hinged objects to which they may be attached. As shown in FIG. 1, continuous hinges may typically have lengths $L_{66}$, $L_{67}$ greater than at least five times their widths $W_{66}$, $W_{67}$, respectively.

In the preferred embodiment, one of the leaves 66, 67 may include a plurality of conventional round mounting holes such as fastener holes 68 shown in leaf 66. Fastener holes 68 may be used to attach hinge member 61 to a hinged object, which for purposes of illustration and discussion only may be a door frame 76 as shown in FIGS. 3-6.

The other leaf 67 preferably includes a combination of different type fastener holes which may be used to attach hinge member 62 to a hinged object, which for purposes of illustration and discussion only may be a door 75 as shown in FIGS. 3-6. In the embodiment shown, leaf 67 includes a combination of conventional round fastener holes 68, vertical slots 69, and horizontal slots 70. As previously described, the combination of holes 68, 69, and 70 provided in leaf 67 allows the door to be adjusted and aligned with respect to the frame during the process of mounting hinge member 62 to the door. This enables a door installer to achieve the proper alignment and clearances needed for proper operation of the door. With continuing reference to FIGS. 1 & 2, leaf 67 in one possible embodiment includes three vertical slots 69 and three horizontal slots 70 interspersed between conventional round holes 68. Preferably, and without limitation, vertical and horizontal slots 69, 70 are provided at least proximate to opposite ends 71, 72 of leaf 67. During the process of mounting leaf 67 to door 75 with fasteners, by employing various installation sequences described herein, the hole combination and placement on leaf 67 advantageously provides ready adjustment of the top and bottom of hinge member 62 (i.e., ends 71, 72) on door 75 or other hinged object to be attached to hinge member 62. This ensures that proper alignment of door 75 within frame 76 may be achieved that results in a properly functioning and hung door.

It will be appreciated that the number of holes 68, 69, and 70, and their arrangement on leaf 67, may be varied in numerous different and suitable ways so long as door 75 (or other hinged object) attached to hinge member 62 may be aligned and adjusted during mounting with respect to frame 76 as described above. Accordingly, the invention is not limited to the combination and configuration of different types of holes shown in FIGS. 1 & 2, and other embodiments are contemplated. For example, vertical and horizontal slots 69 and 70 may be provided near mid-length of leaf 67 (not shown). In addition, it will be appreciated that both leaves 66, 67 may include a combination of conventional round fastener holes 68 and vertical slots 69 and/or horizontal slots 70 as shown in the alternate embodiments depicted in FIGS. 7 & 8.

Round fastener holes 68 may have straight sides which preferably may be used in conjunction with fasteners commonly used in the art such as self-tapping screw 50 (shown in FIG. 9) to attach hinge leaves 66, 67 to hinged objects. Screw 50 includes a shank 52, which may have a self-drilling point at one end 53, and an opposite end attached to a head 51 having straight sides 59 and attached flange 51*a*. Head 51 may have a hexagonal shape for engagement with a standard socket driven by hand or a power tool.

Figure 9:
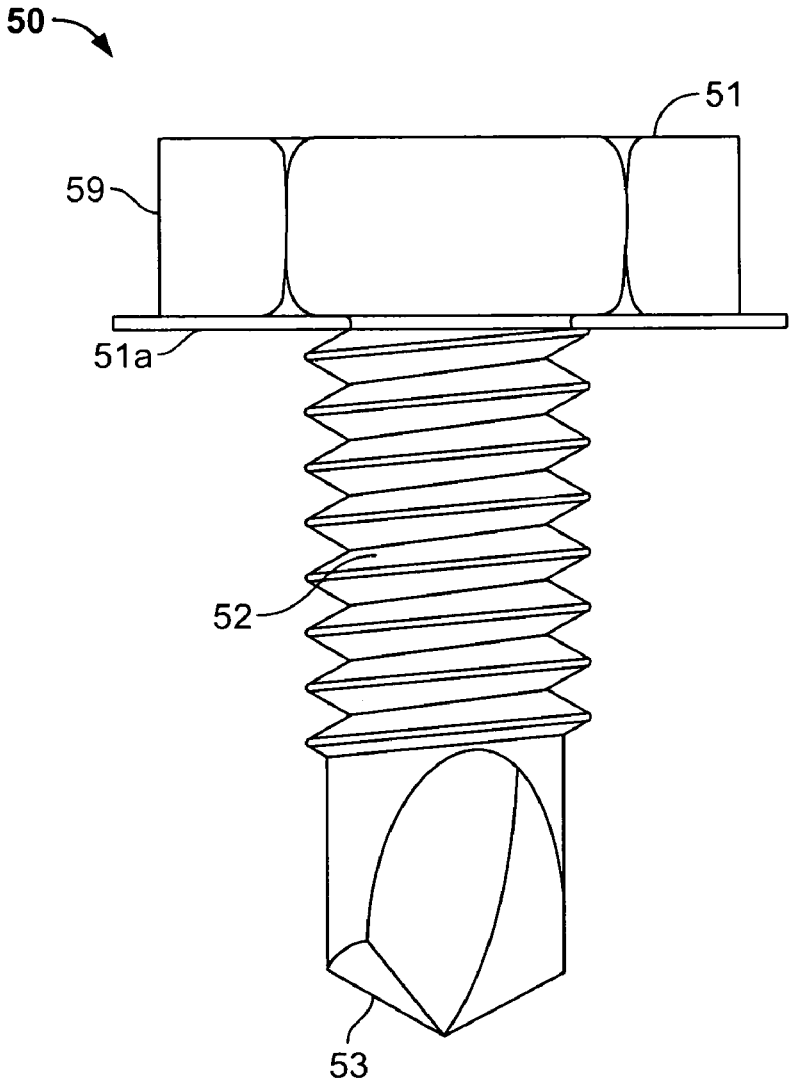
FIG. 9 is a side view of a standard mounting fastener that may be used with the hinge of FIG. 1.
Figure 10:
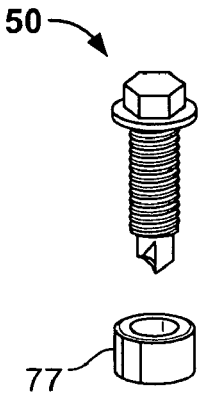
FIG. 10 is a perspective view of the fastener of FIG. 9 with an attachable bushing.
Figure 11:
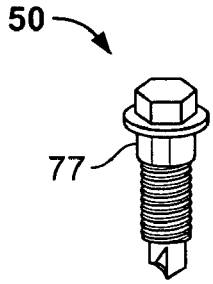
FIG. 11 is a perspective view of the fastener of FIG. 9 with an integral bushing.

For vertical and horizontal slots 69, 70, screw 50 as shown in FIG. 9 may be used with the slots preferably having straight sides similar to fastener holes 68. However, in a preferred embodiment, screw 50 may further be provided with a bushing or ferrule (sleeve) 77 as shown in FIGS. 10 & 11 to facilitate sliding of screw 50 within slots 69, 70. As shown in FIG. 10, bushing 77 may be a separate component through which shank 52 is inserted during the hinge installation process. Bushing 77 may be made of any suitable material, included but not limited to steel, brass, plastic, etc. Alternatively, bushing 77 may be formed as an integral part of or permanently attached to screw 50 as shown in FIG. 11.

Figure 23:
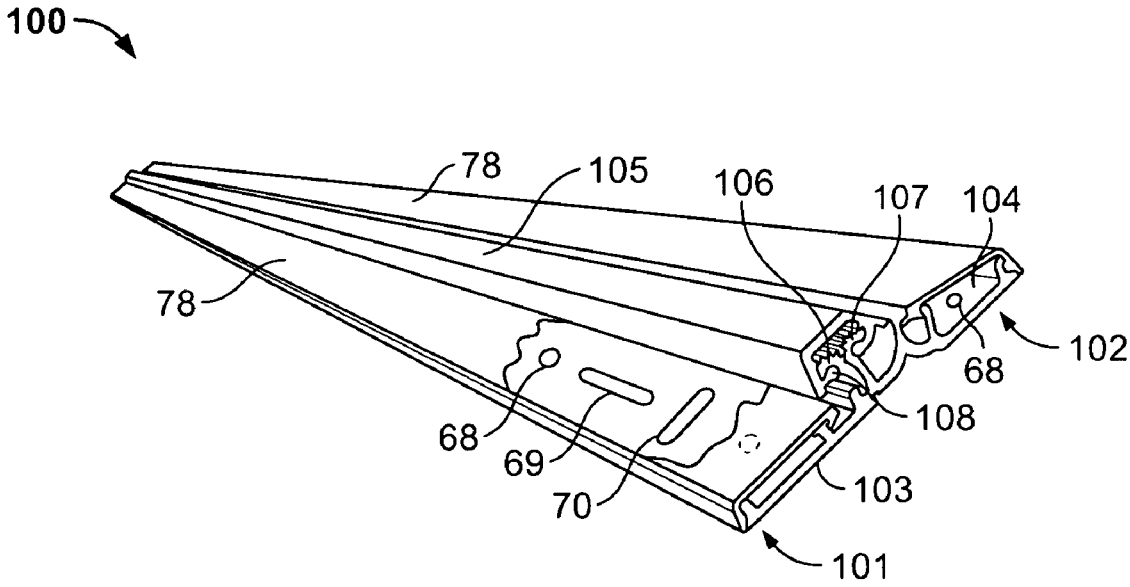
FIG. 23 is a perspective view of another embodiment of a hinge having a vertically and horizontally adjustable hinge member.

Use of screw 50 will result in screw head 51 being exposed and projecting above the top of the leaf when installed on a hinged object. To provide security against tampering with screw 50 and/or to improve aesthetic appearances of the installed hinge 60, leaves 66, 67 may be fitted with ornamental moldings or covers 78 such as shown in FIG. 23. Cover 78 may be provided with in a variety of ornamental shapes dictated solely by aesthetic considerations according to the discretion of the industrial designer. Cover 78 may be cooperatively configured with the hinge leaves to snap onto or slide onto the leaves.

Figure 3:
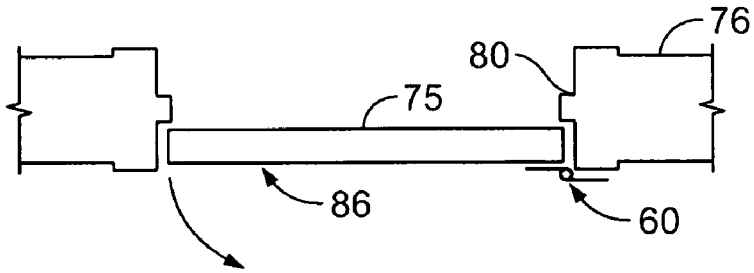
FIG. 3 is a top view of a typical full-surface hinge mount installation using the hinge of FIG. 1.

It should be noted that hinge 60 may used in many different types of door and frame mounting applications, such as but not limited to those depicted in FIGS. 3-6. In FIG. 3, for example, the combination of vertical and horizontal slots 69, 70 shown in FIGS. 1 & 2 allows for adjustment of door 75 in the X and Y planes for the full-surface hinge mount shown. The X plane is defined in the horizontal direction, the Y plane is defined in the vertical direction, and the Z plane is defined as being perpendicular to both the X and Y planes with respect to an orientation commonly encountered when hanging a vertical door on a vertical frame (see, e.g., FIG. 13). The fully-concealed hinge 60 mount shown in FIG. 4 allows for adjustment of door 75 in the Y and Z planes. The half-surface hinge 60 mount shown in FIG. 5 allows for adjustment of door 75 in the X, Y and Z planes, as does the alternative half-surface hinge 60 mount shown in FIG. 6.

A method of using the preferred embodiment of hinge 60 will now be described by way of example with reference to aligning and installing a movable door to a stationary frame. In this example, all of the specially-shaped holes or slots 69, 70 are preferably embodied in the moving hinge member leaf 67, as shown in FIGS. 1 & 2, which is to be applied to the face of the door 75. The conventional round attachment holes 68 in this embodiment are provided in the fixed hinge member leaf 66 which is applied to the face of the frame 76. The completed full-surface hinge mount installation is shown in FIG. 3.

Figure 13:
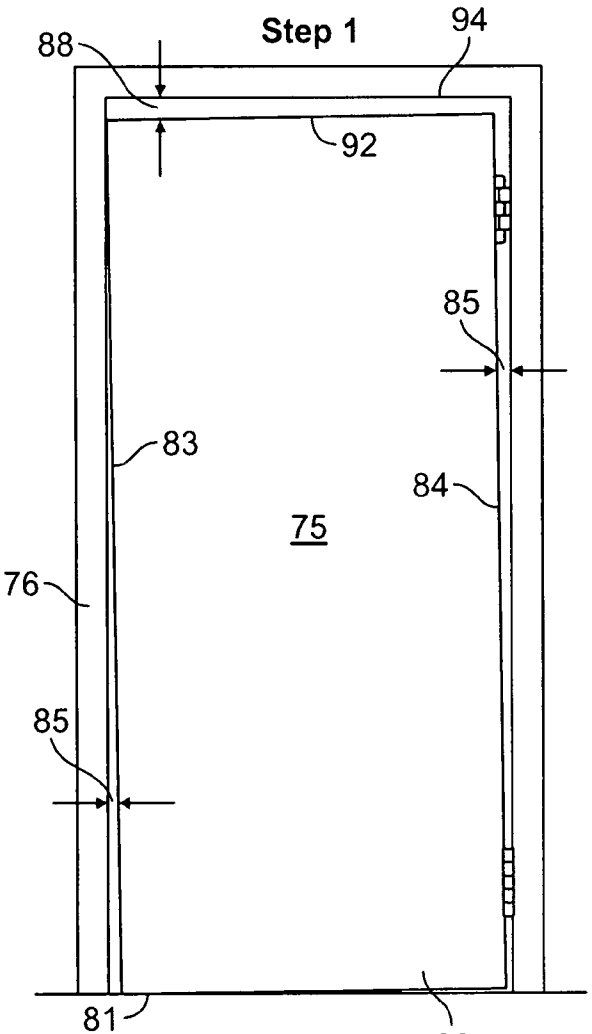

With reference to FIGS. 13-20, a preferred installation sequence is as follows:

Step 1. Referring to FIG. 13, the door 75 may be positioned in the plane of its frame 76 (preferably against the frame "stops" 80 shown in FIG. 3) so that it is resting on the floor or its threshold 81. An initial and generally large clearance 88 results at the top of the door 75 between the horizontal top or "head" 94 part of frame 76 and the top edge 92 of the door. It will be understood that if the installation is a repair or retrofit, the old hinge hardware will have been removed first (note that in FIG. 13, the butt hinges are still shown attached to the existing door 75 for sake of illustration). It will be further understood that if an existing door is heavy or difficult to move because of the failure of the original hinges, those hinges may advantageously be removed by sawing or grinding them away without any requirement for moving the door from its closed position.

Figure 14:
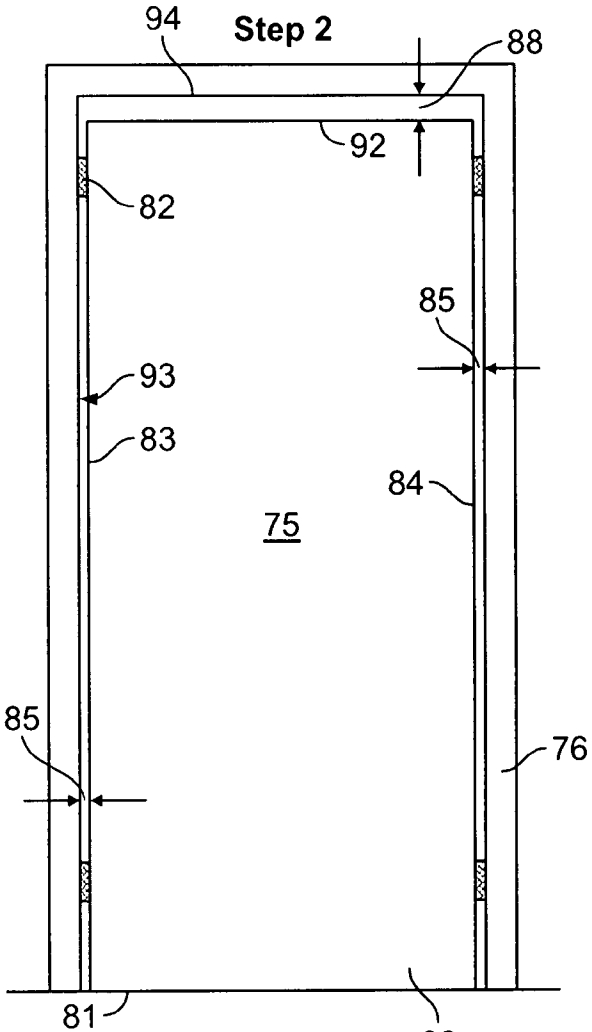
FIGS. 13-20 show one embodiment of a sequence to align and mount a door to a frame using the hinge of FIG. 1.

Step 2. Referring to FIG. 14, the door may be shimmed laterally with temporary wedges or shims 82 between its vertical edges 83, 84 and the door frame jamb 93 to approximate the vertical clearances 85 desired on the lock or latching side 83 and the hinge side 84 of the door 75. The wedges or shims also assist in keep the door from slipping out of the plane of the frame (i.e., in a direction normal to the door face 86 best seen in FIG. 3, for example). Alternatively, it should be noted that the shimming may be done entirely on one side of the door alone, such as the hinge side 84 so that the lock side 83 of the door 75 is abutted against door frame jamb 93. As commonly known in the industry, the lock side 83 clearance is generally more important because a small (approximately 1/16 to 1/8 inch typically) and uniform clearance should be provided on this side for proper locking and latching of the door. For full-face continuous hinges, this is especially true since the hinge conceals any variances on the hinge side 84 vertical clearance 85 between the door 75 and frame 76. It is also commonly known that a proper hinge side 84 vertical clearance 85 should be obtained to prevent rubbing of the door and frame 76 during operation. The hinges and installation sequence described herein, however, allows optimum clearances 85 to be readily obtained along either side of the door 75 depending on the needs of the particular installation scenario encountered.

It will also be appreciated that in lieu of using separate wedges or shims as shown in FIG. 14, a long continuous hinge of suitable material may be used. Further shims may be employed during latter stages of the preferred installation sequence described below instead of or in addition to Step 2 to ensure the necessary lock side 83 and/or hinge side 84 vertical clearances 85 are achieved.

Figure 15:
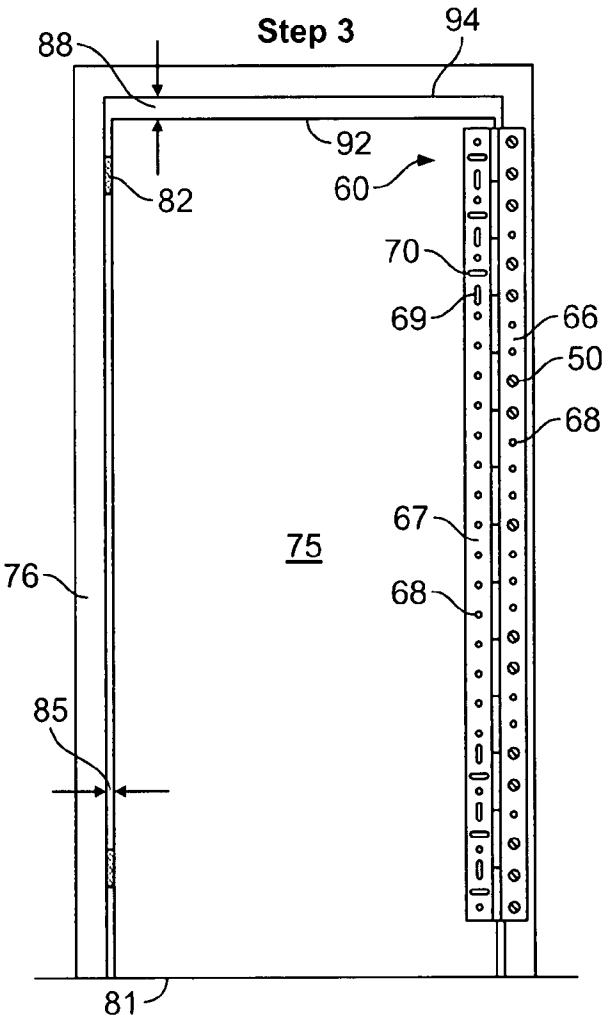

Step 3. Referring to FIG. 15, the continuous hinge frame leaf 66 (fixed leaf) may be positioned more or less parallel to the vertical frame 76 member and securely fixedly attached with some or most of its fasteners such as screw 50 (see FIG. 10) to the door frame 76.

Figure 16:
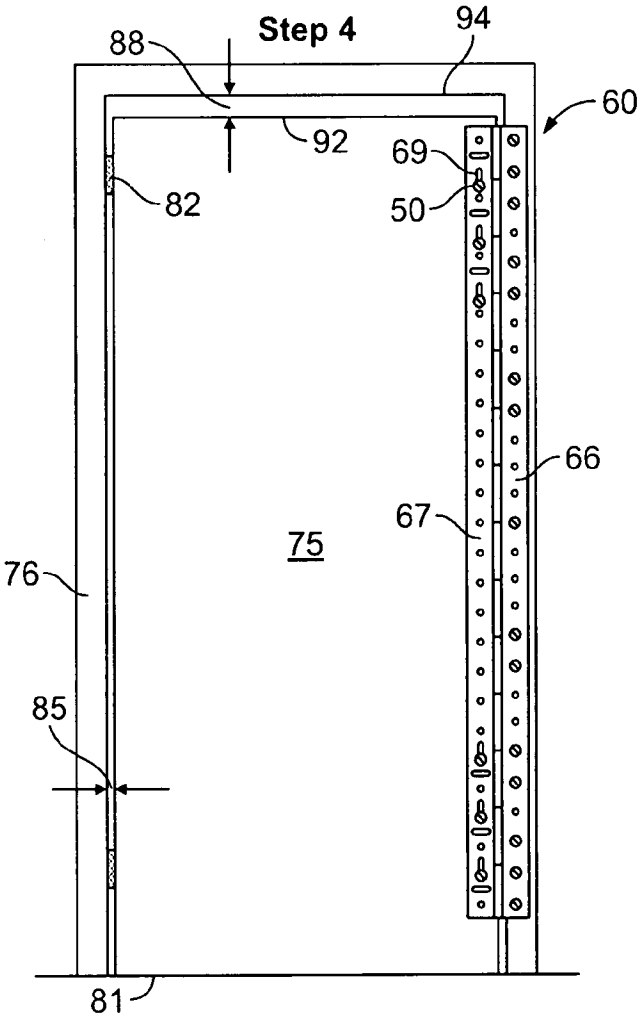

Step 4. Referring to FIG. 16, the moving leaf 67 may be attached to the door 75 by inserting one screw 50 (preferably with bushing 77 as shown in either FIG. 10 or 11) into the door through at least one of the vertical slots 69 near the top edge 71 of the moving leaf 67, and preferably inserting one screw in at least one of the vertical slots 69 near the bottom edge 72 of the moving hinge leaf 67. Preferably, screws 50 are inserted in more than one vertical slot 69 near both the top and bottom edges 71, 72 of leaf 67. Each of these screws 50 is preferably inserted at the bottom end of its respective vertical slot 69. These screws 50 are preferably not fully inserted and tightened, but left with sufficient head clearance to allow the door and screws attached thereto to slip with relative movement with respect to and in slot 69, yet tight or snug enough to prevent excess movement of the hinge leaf away from and perpendicular to the surface 86 (see FIG. 3) of the door 75.

Figure 17:
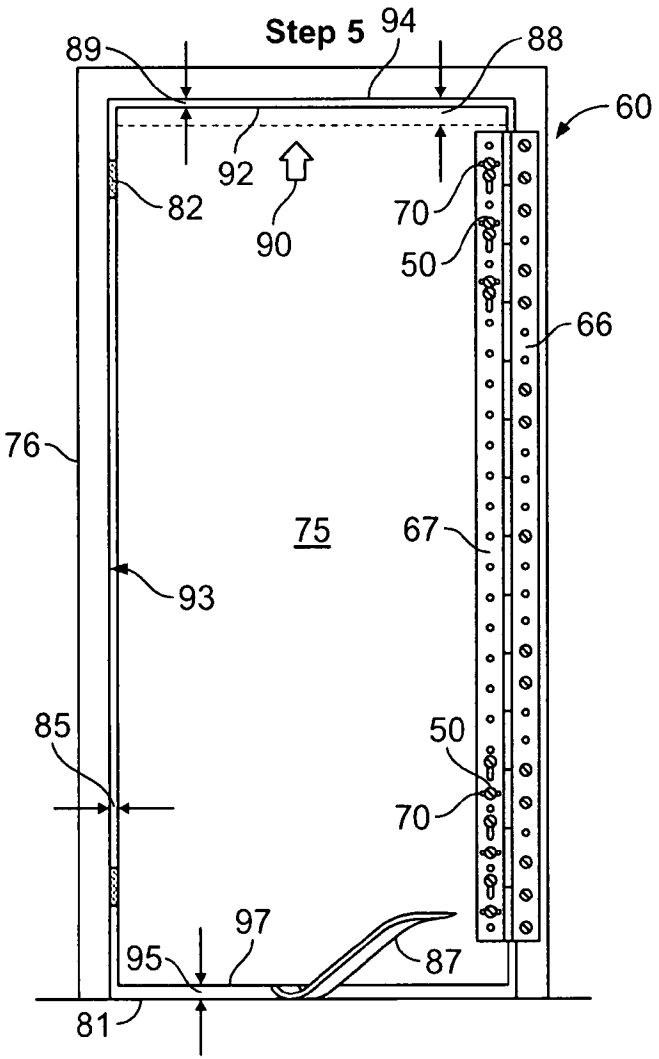

Step 5. Referring to FIG. 17, with the door 75 thus secured in approximation to its desired lateral position by the screws 50 in the vertical slots 69 and further guided by the shims 82 along its vertical edges 83, 84, the door 75 may be raised and adjusted vertically (in the direction of arrow 90) from its threshold 81 by a pry-bar 87 or other means until the top edge 92 of the door 75 is positioned to the desired operating clearance 89 from the top or "head" of the frame. The initial starting position of top edge 92 of the door 75 is shown in dashed lines for reference. Clearance 95 is concomitantly created at the bottom edge 97 of the door 75 above the threshold 81. Shims or wedges may optionally be placed (not shown) under the door 75 to maintain the desired height so that the pry-bar 87 can be removed. Screws 50 are preferably then driven into the door 75 through the mid-point or center of one or more of the horizontal slots 70 near both the top and bottom edges of the moving leaf 67. The screws 50 are preferably not fully inserted and tightened similar to Step 4 above, but only tightened enough for a snug, slideable fit in slots 70. The final desired height or vertical position of door 75 with respect to frame 76 is thus established.

Figure 18:
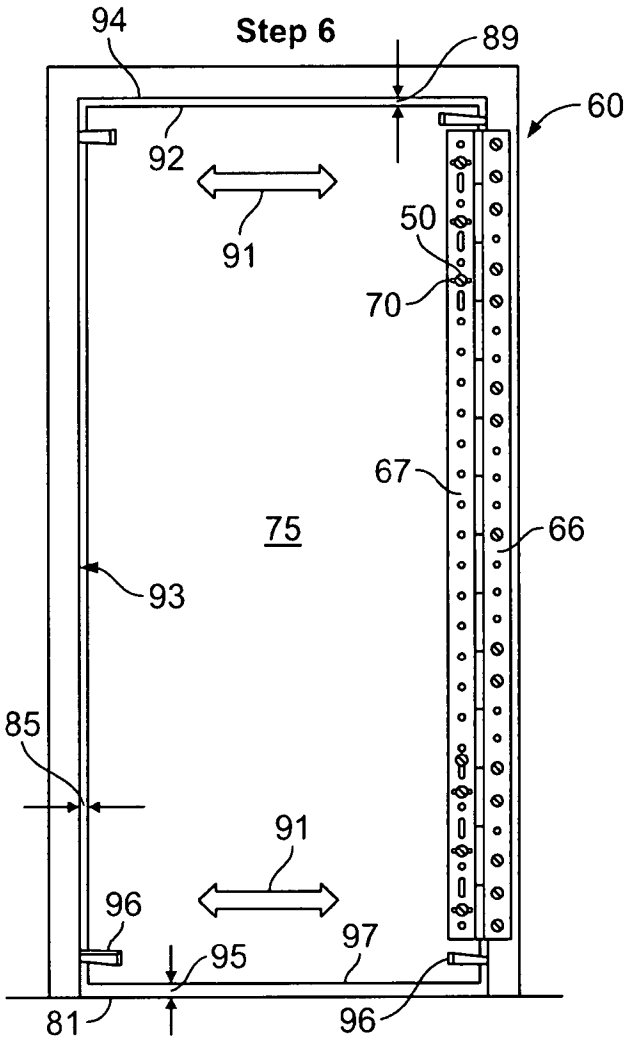

Step 6. Referring to FIG. 18, the vertical shims 82 of Step 2, the screws 50 in the vertical slots 69 of Step 4, and the bottom wedges or shims if used of Step 5 (not shown) may then be removed so that the door 75 is free to be adjusted from side to side. The vertical height of the door 75 (and the retention of the moving leaf 67 against the surface 86 of the door) may be maintained by the screws 50 inserted in the horizontal slots 70 in step 5. With the vertical height and position of door 75 maintained by the horizontal slots 70, the door 75 may be further adjusted laterally from side to side as indicated by directional arrow 91, as needed, to achieve for example a specified clearance 85 between the door frame jamb 93 and door edge 83 which favors the lock or latching side of the door, or as otherwise determined by the installer and approved construction practices. When the desired door-to-door frame jamb clearance 85 or other vertical clearance is obtained, the door may be wedged with wedges 96 as shown preferably along both door side edges 83, 84 to maintain the clearance.

Figure 19:
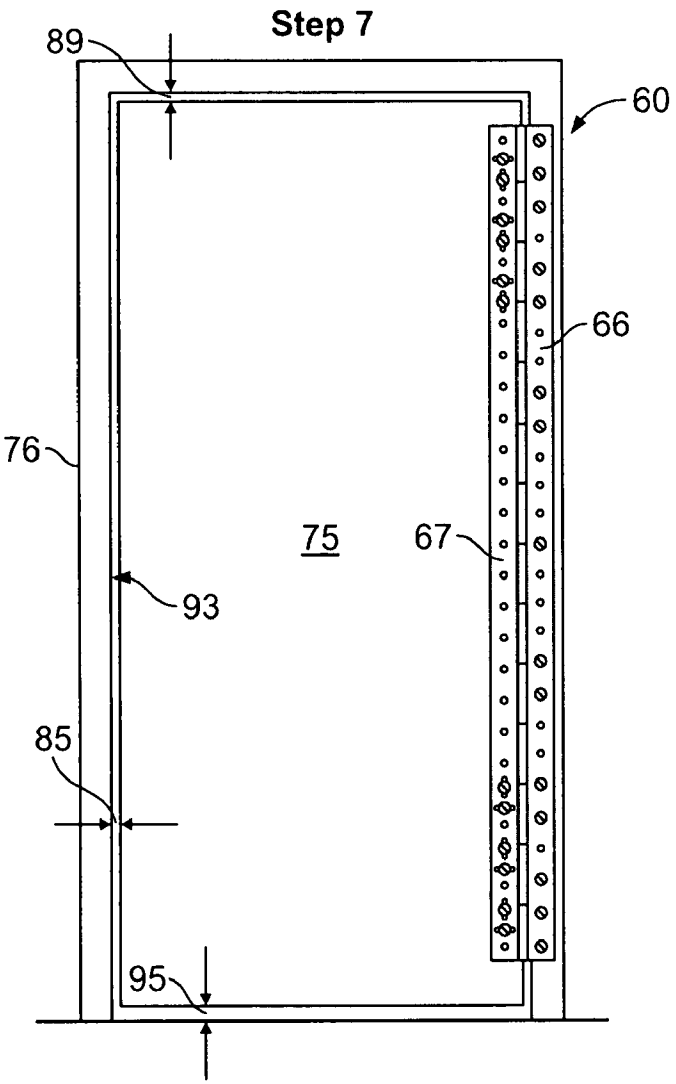

Step 7. Referring to FIG. 19, the screws 50 which had been removed from the vertical slots 69 in Step 6 are then replaced at fresh locations within the vertical slots to prevent any further lateral door displacement or movement. This essentially locks in place the final lateral position of door 75 that was temporarily established in Step 6.

Figure 20:
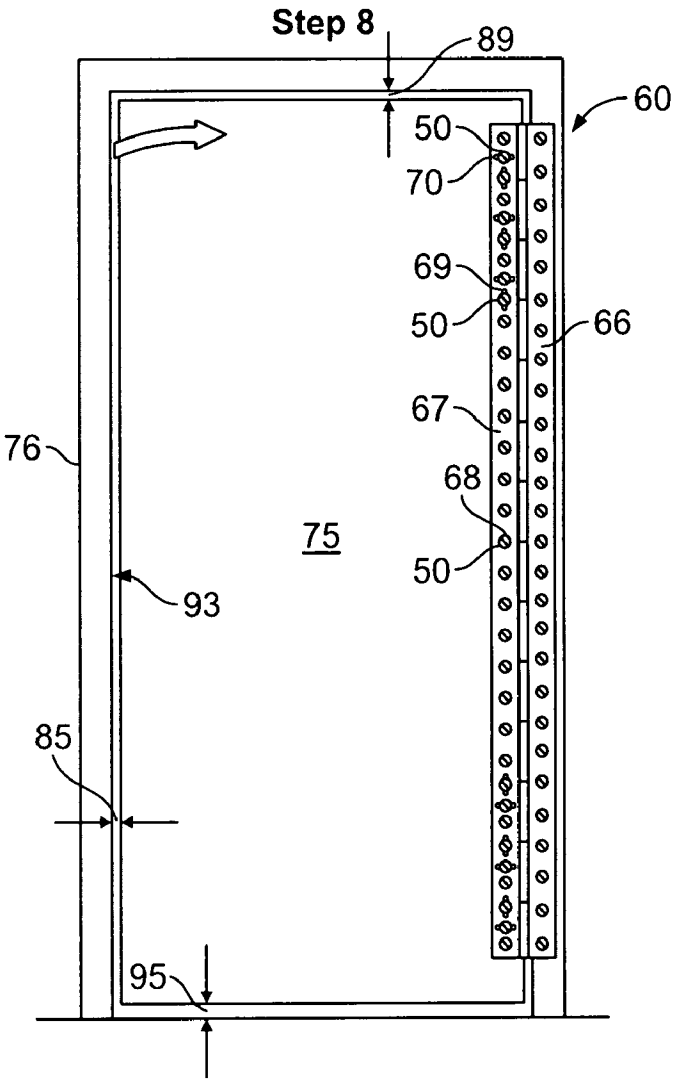

Step 8. Referring to FIG. 20, all screws 50 in the vertical and horizontal slots 69, 70 may then be tightened. The door may then be moved through a trial swing to check for proper vertical and lateral operating clearances. Upon approval of door fit and satisfactory function, additional screws 50 may then be inserted though the conventional round holes 68 in both leaves to effectively "pin" the door 75 into its final position, thus permanently securing the hinge 60 for continued operation.

It will be understood that Steps 4-7 can be repeated if needed, using fresh hole locations for each of the screws to achieve an optimal door position. This may be particularly useful for retrofitted doors to modify operating clearances for existing locks and latches which may be tested as part of Step 8.

It will also be understood that the screws in the vertical slots 69 at only the top or the bottom can be removed for independent adjustment of either the top or the bottom lateral clearance.

Figure 7:
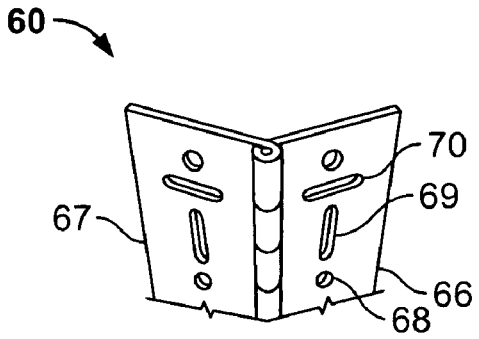
FIG. 7 is a perspective view of another embodiment of the hinge of FIG. 1 having a second vertically and horizontally adjustable hinge member.

It will be further understood also that the frame leaf 66 can optionally be prepared with similarly slotted holes to the moving door leaf 67, as shown in FIG. 7. Accordingly, leaf 66 may have the same combination of round holes 68 and slotted holes 69, 70 as leaf 67. This combination allows the door 75 to be aligned within frame 76 both horizontally and vertically using either the frame leaf 66 and/or door leaf 67 to make the necessary adjustments. In one possible embodiment of a door installation sequence therefore, after Step 2 is completed as above wherein the door has been laterally aligned, the door leaf 67 may be fixedly secured to door 75 using round holes 68. Steps 4 through 8 above may then be completed for the frame leaf 66 wherein the vertical and horizontal position of the door is adjusted.

Figure 8:
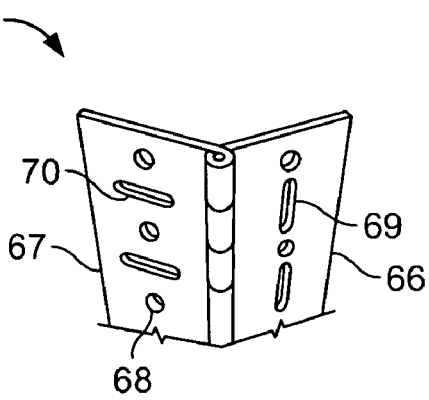
FIG. 8 is a perspective view of another embodiment of the hinge of FIG. 1 having a vertically adjustable hinge member and a horizontally adjustable hinge member.

Alternatively, the frame leaf 66 may contain the vertically slotted holes 69 for vertical adjustment and the door leaf 67 may contain the horizontally slotted holes 70 for lateral adjustment of the door, as shown in FIG. 8, or alternatively the reverse arrangement can be used to achieve the same end result of a properly aligned and hung door. In one possible embodiment of an installation sequence using the hinge leaf configuration of FIG. 8, Step 2 above may be completed wherein the door 75 has been properly aligned and wedged or shimmed in place within frame 76. The door leaf 67 may then be secured to the door 75 by inserting one or more screws 50 into the door through preferably the center of the horizontal slots 70 to allow for maximum range of horizontal adjustment later in the installation sequence. Preferably, the screws 50 are firmly tightened in the slots 70 so that leaf 67 is rigidly attached to the door 75, albeit only temporarily pending later horizontal adjust if required. Alternatively, screws 50 may be inserted through some of the round holes 68 in door leaf 67 in lieu of or in addition to the horizontal slots 70. The frame leaf 66 may next be attached to the frame 76 by inserting screws 50 preferably into the tops of vertical slots 69 in the frame leaf. Screws 50 are preferably only snugly tightened to allow movement of the screws within slots 69. Next, with the door 75 firmly attached to door leaf 67, Step 5 above is performed wherein the desired vertical position of the door is achieved as shown FIG. 17. Screws 50 may then be driven into the frame 76 through the round holes 68 in the frame leaf to fix the vertical position of the door 75. Finally, the screws 50 located in the horizontal slots 70 of the door leaf 67 may be loosened and final lateral adjustments may be made to the door as in Step 6 shown in FIG. 18. Once the final lateral position has been achieved, screws 50 may then be inserted through the round holes 68 in the door leaf 67 to fix the lateral position of the door in frame 76. Alternatively, if the door leaf 67 were initially fixedly attached to the door 75 using the round holes 68 in the door leaf, screws 50 would first be inserted into the horizontal slots 70 of the door leaf (with a snug and slideable fit only) and then the screws would be removed from the round holes 68 to allow the lateral position of the door to be adjusted as required. Once the final lateral position has been achieved, screws 50 may then be inserted through the round holes 68 in the door leaf 67 to fix the lateral position of the door in frame 76.

If the layout of vertical slots 69 and horizontal slots 70 were reversed from that shown in FIG. 8 (i.e., door leaf 67 including the vertical slots and frame leaf 66 including the horizontal slots), the foregoing sequence just described would be altered slightly. The frame leaf 66 with the horizontal slots 70 would preferably first be fixedly attached to the frame 76 using the slots 70 or round holes similar to that described above. The door leaf 67 would next be secured to the door 75 by inserting screws 50 into the bottoms of the vertical slots 69 therein (with only a snug and slideable fit). And the adjustment sequence for the vertical and horizontal position of the door would be completed similarly to that described immediately above.

From the foregoing examples of installation sequences, it will be appreciated by one skilled in the art that the above described and other alternate hinge leaf embodiments varying the combination and placement of round holes 68, vertical slots 69, and horizontal slots 70 may be used to achieve a properly aligned and mounted door so long as the preferred basic sequence is used of: (1) adjusting the vertical position of the door first as described in Step 5 above, and then (2) adjusting the horizontal position of the door second as described in Step 6 above. These two basic steps are further preferably preceded by Steps 1 and 2 above in all installation sequences.

Figure 4:
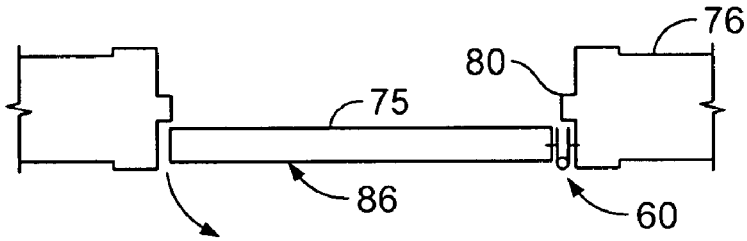
FIG. 4 is a top view of a typical fully-concealed hinge mount installation using the hinge of FIG. 1.

If both leaves are fully concealed as shown in FIG. 4 (both leaves concealed between the door and the frame), the adjustment may be vertical as well as in and out of the plane of the frame.

Figure 5:
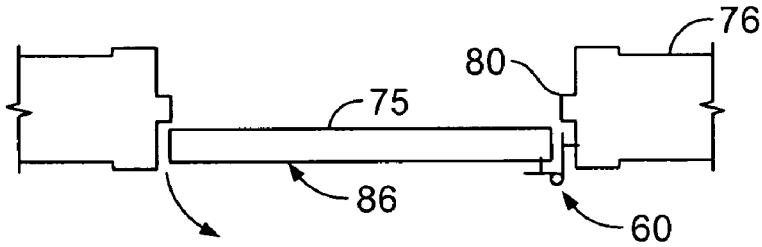
FIG. 5 is a top view of one typical half-surface hinge mount installation using the hinge of FIG. 1.
Figure 6:
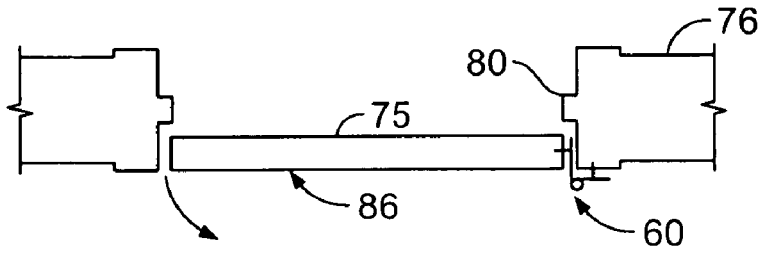
FIG. 6 is a top view of another typical half-surface hinge mount installation using the hinge of FIG. 1.

If the hinge is a half-surface hinge as shown in FIGS. 5 & 6 (the frame leaf attached to the jamb or rabbet of the frame and the door leaf attached to the face of the door), the door adjustment may be either a combination of A) lateral and vertical if the slotted holes are fabricated in the door leaf, or B) in-and-out of the plane of the frame and vertical if the slotted holes are fabricated in the frame leaf, or C) in-and-out of the plane of the frame, vertical and lateral if the slotted holes are distributed between both leaves or hinge members. A preferred embodiment of a half-surface hinge could thereby achieve door adjustability of a sufficient range to accommodate frames that are out-of-plumb in several planes as well as of uneven height.

It will be appreciated from the foregoing description that the hinge and installation methodology described herein provides the ability heretofore lacking to easily fine tune the vertical and horizontal clearances between a door and frame. This is particularly advantageous for large-scale door retrofit projects where many old doors in an entire building may need to be replaced. The door frames and thresholds may be in various states of disrepair and have varying horizontal and vertical clearances between door and frame. Therefore, differences may exist from door-to-door and even within the frame of a single door where clearances may vary from top of the door frame to bottom and side to side. Accordingly, the ability to supply a single size door whose installation that can then be adapted to suit the varying conditions encountered for each door installation is particularly advantages in terms of installation time and cost savings. The invention described herein provides such advantages by allowing uniformity of vertical and horizontal door-to-frame clearances to be achieved for each newly installed door. Therefore, the invention and installation method described herein is particularly well-suited for such retrofit projects.

Figure 21:
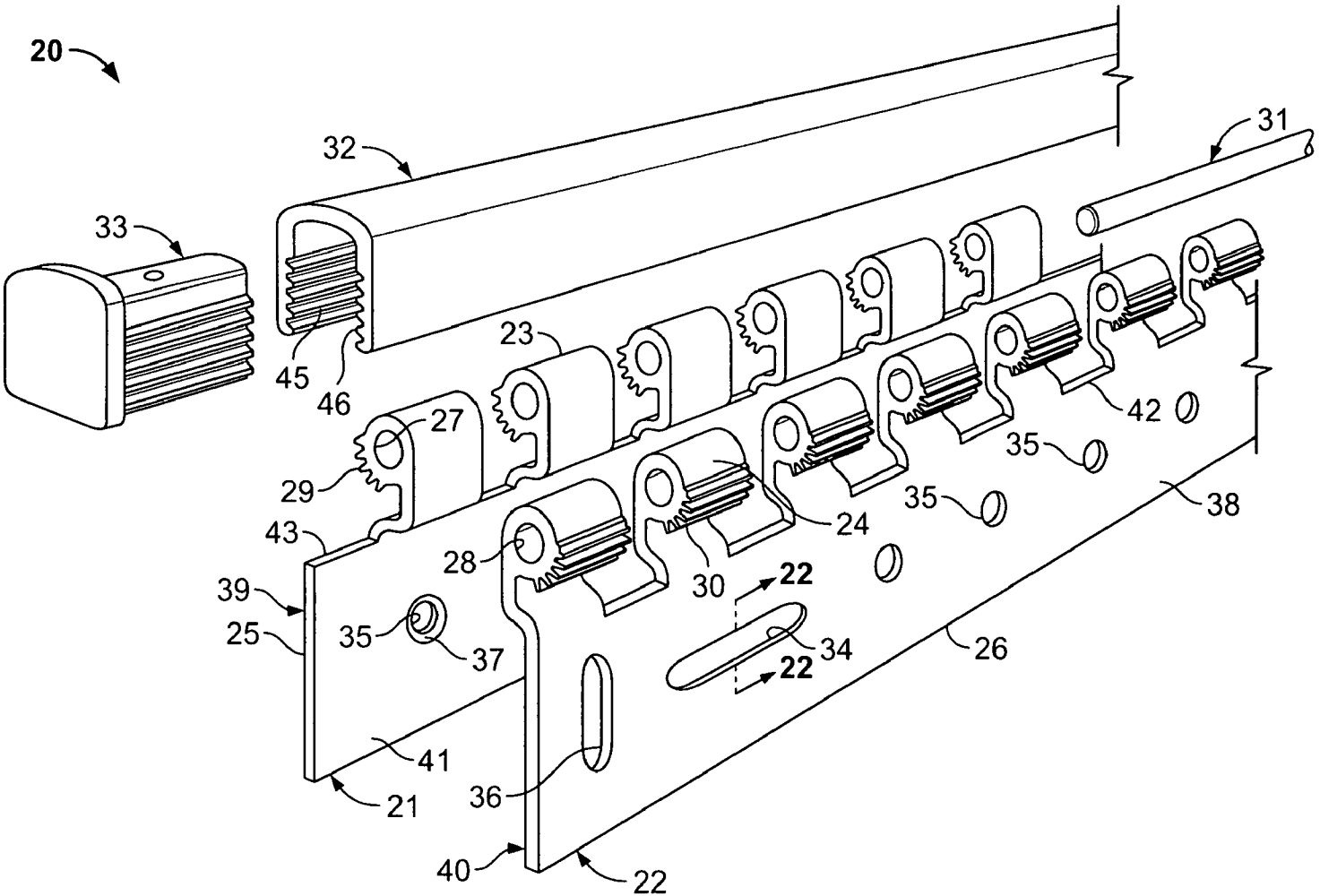
FIG. 21 is a perspective view of another embodiment of a hinge having a vertically and horizontally adjustable hinge member.

Referring to FIG. 21, there is shown without limitation a preferred embodiment of a pin and knuckle or barrel continuous hinge 20 of the type described in U.S. Pat. No. 5,991,975 to Austin Baer (incorporated herein by reference) that incorporates the hinge attachment system as described herein.

Hinge 20 preferably includes at least two hinge members 21, 22 each having knuckles or barrels 23, 24 and leaves 25, 26 connected thereto, respectively. Leaves 25, 26 each further include at least one longitudinally-extending edge 42, 43, on which knuckles 23, 24 may be formed as shown, respectively. Knuckles 23, 24 each have a longitudinally extending opening 27, 28 extending through each knuckle. When openings 27 and 28 are concentrically aligned, a central passageway is formed to receive longitudinally-extending pin 31 for pivotally connecting the knuckles 23, 24 of hinge members 21, 22. Preferably, the knuckles 23, 24 of each hinge member 21, 22 are spaced apart in the longitudinal direction along the length of their respective hinge members with longitudinally extending gaps created therebetween to allow the knuckles of the opposing hinge member to be interspersed for pivotable connection by pin 31.

Still referring to FIG. 21, hinge members 21 and 22 may be provided with gear segments 29 and 30, respectively. Gear segments 29, 30 serve as driving members which in one embodiment interact and mesh with driven members, such as gear segments 45, 46, disposed in a longitudinally-extending cover 32. Gear segments 45, 46 may be in the form of opposing gear racks as shown in FIG. 1 such that cover 32 is mechanically articulated and radially displaceable with respect to pin 31 by opening and closing hinge members 21 and 22. End covers 33 may be provided to seal the openings at either end of cover 32. Cover 32 serves to enclose knuckles 23, 24 to provide an aesthetically pleasing appearance and protect the knuckles from the environment.

Figure 12:
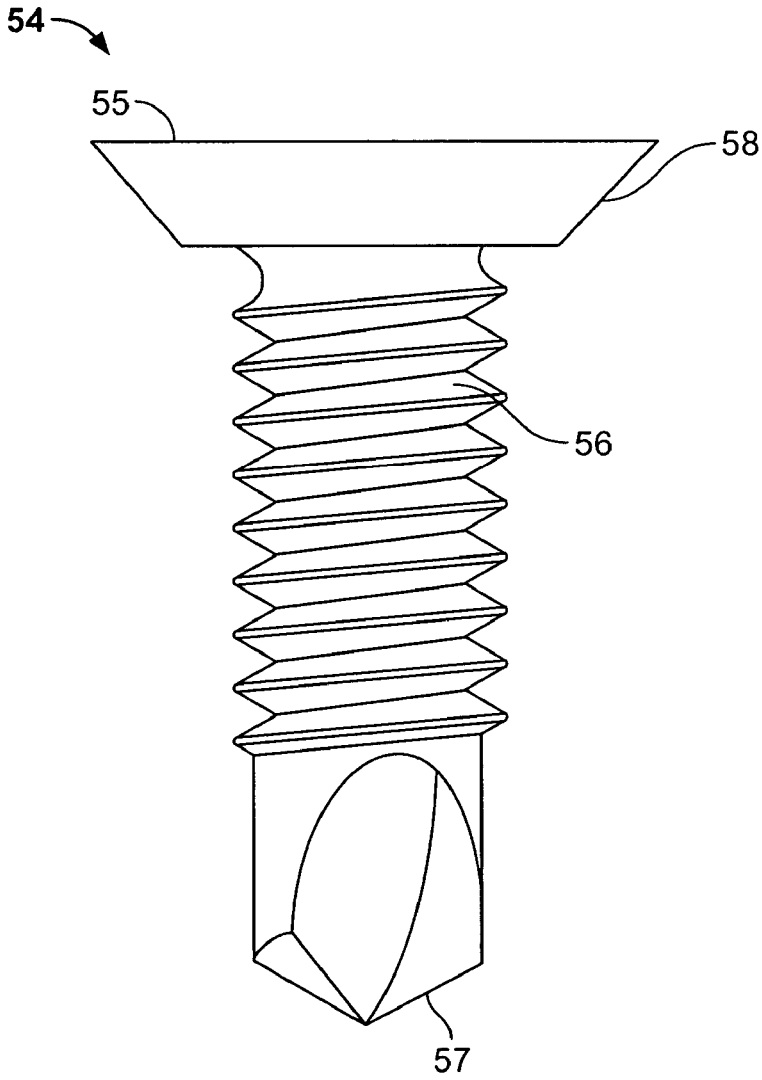
FIG. 12 is a side view of a standard undercut conical head fastener that may be used with the hinge of FIG. 1.

In the embodiment as shown in FIG. 12, hinge leaves 25, 26 preferably define a plurality of round holes 35 for receiving fasteners, such as self-tapping screws with drill points, for mounting the hinge leaves to hinged objects. In one exemplary and typical installation of an architectural type door, leaf 25 may be the fixed leaf being secured to a stationary door frame while leaf 26 may be a movable leaf being secured to a swinging door. Alternatively, both leaves 25, 26 may be mounted to moving objects such as two doors being pivotally connected together as may be encountered in bi-fold or tri-fold door installations.

In one embodiment, holes 35 may have a conical side walls 37 thereby forming a conically-shaped recess configured to receive a complimentary-shaped fastener, such as a standard undercut flat head self-tapping screw 54 of the type shown in FIG. 12. Screw 54 includes a threaded shank 56 having an end 57 which may be formed with a sharpened self-drilling point and an opposite end attached to screw head 55 having conically-shaped sides 58. Screw 54 may be a standard No. 12 undercut flat head screw configured and dimensioned per American National Standards Institute (ANSI) Standard B 18.6.4 published in 1999. In many applications, such No. 12 ANSI screws have become the industry standard for attaching heavy duty architectural type doors to frames using continuous hinges. When screw head 55 is seated in hole 35, as when securing leaf 25 to a door or frame, the top of screw 54 will preferably be flush with the topside of the leaf. Similarly, holes 35 in leaf 26 may also be provided with a conical side surface.

At least one of the leaves 25, 26 may be provided with at least one vertical or longitudinal slot 34 and at least one horizontal or transverse slot 36, such as shown for leaf 26 in FIG. 21. It will be appreciated that a series of round holes 68, vertical slots 69, and horizontal slots 70 and combinations thereof may be provided as shown in FIG. 2.

Figure 22:
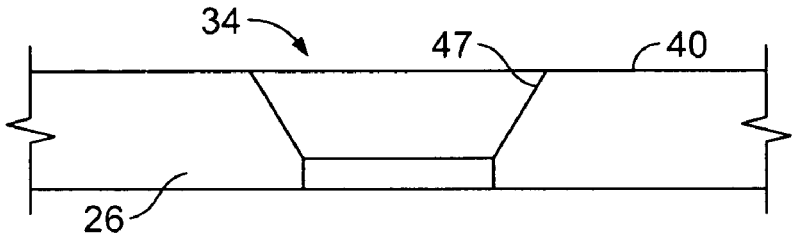
FIG. 22 is a cross-sectional view taken through one of the slotted holes of the hinge of FIG. 21.

Vertical and horizontal slots 34, 36 may have straight sides to receive the shank of a conventional fastener such as screw 50 (see FIG. 9). Alternatively, if round holes 68 are provided with conical side walls 37 as discussed above, slots 34, 36 may similarly be formed with conical side walls 47 (best seen in FIG. 22) that are configured to receive the heads of complimentary-shaped flat top screws 55 shown in FIG. 12. This allows the screw heads to be similarly flush with the top surface of leaf 26. The use of conical screws 55 minimizes the leaf-to-leaf clearance needed for fully concealed hinge installations as shown in FIG. 4.

Referring to FIG. 23, there is shown without limitation a preferred embodiment of a continuous hinge 100 of the type described in U.S. Pat. No. 3,402,422 to Austin Baer (incorporated herein by reference) that incorporates the hinge attachment system described herein. Hinge 100 has longitudinally extending hinge members 101, 102 with leaves 102, 103 respectively that are pivotally connected along at least a part of their respective longitudinally extending edges by cooperating geared segments 106, 107. Geared segments 106, 107 are operably held in a coupled relationship by a longitudinally extending joining member such as clamp 105. Preferably, clamp 105 is roughly channel shaped in cross section and has two inwardly inclined longitudinally extending edges 108 that operably engage the longitudinally-extending hinge edges, as shown. The hinge leaves 102, 103 may have a longitudinally-extending cover 78 that is used to provide security and enhance the aesthetic appearance of hinge 100 by concealing the fasteners below used to mount the hinge to hinged objects.

At least one of hinge leaves, such as leaf 103 as shown in FIG. 23 with a portion of cover 78 cut away, preferably includes a combination of round holes 68, vertical slots 69, and horizontal slots 70 as described above in conjunction with FIG. 2. Leaf 103 with the combination of holes and slots would preferably be the moving hinge and mounted on a door, for example. The opposing leaf 104 may include a plurality of round holes 68 and would preferably be the fixed hinge mounted on a door frame, for example. Alternatively, both leaves 103, 104 may be provided with a combination of round and slotted holes.

Figure 24:
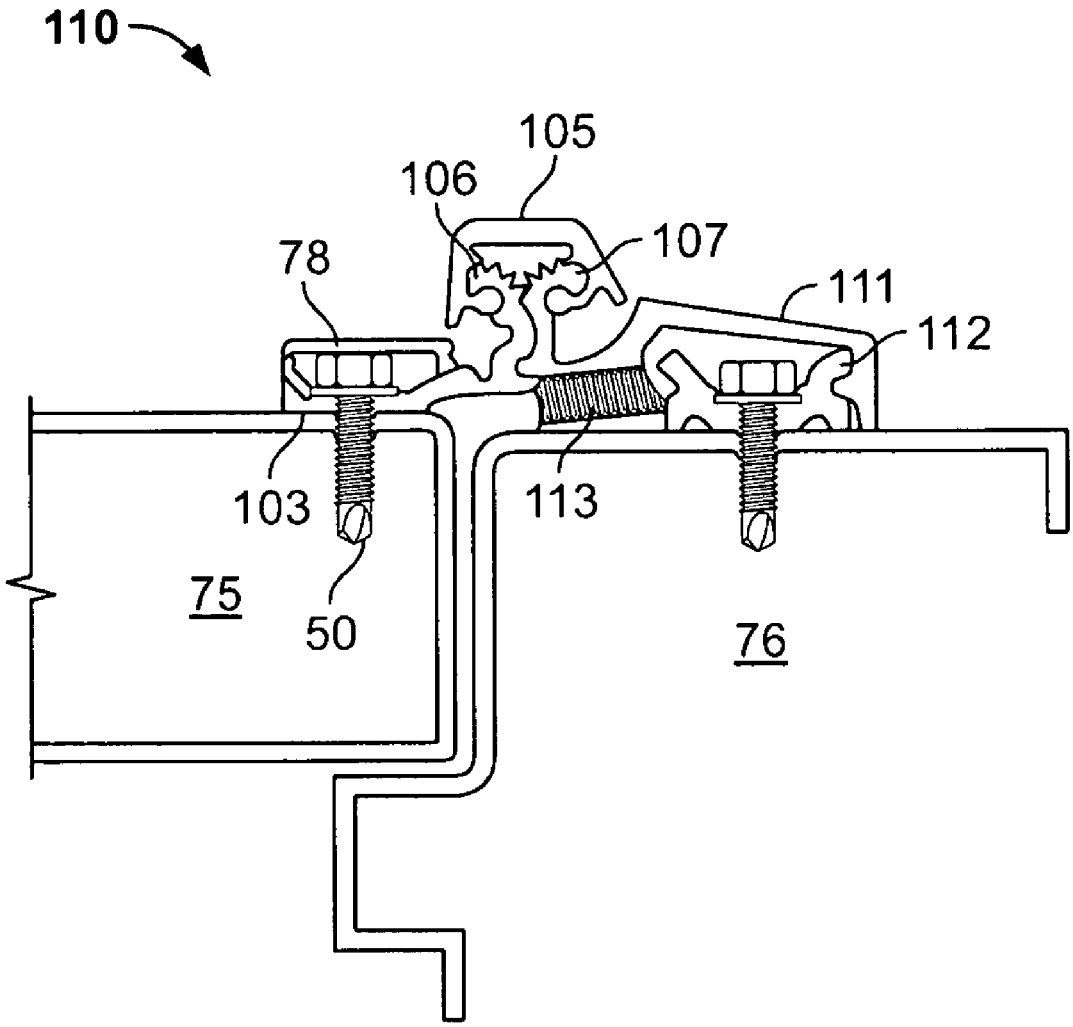
FIG. 24 is an end view of another embodiment of a hinge having the vertically and horizontally adjustable hinge member of FIG. 23 combined with a vertically adjustable rail-mounted hinge member.

Shown in FIG. 24 is an alternative embodiment of a full surface-mounted hinge 110 that combines part of the geared continuous hinge 100 shown in FIG. 23 with a rail-mounted hinge of the type described in U.S. Pat. No. 6,732,409 to Austin Baer (incorporated herein by reference). Hinge 110 is a hybrid combining the slotted hole leaf 103 from hinge 100 (preferably the moving hinge leaf for mounting to a door 75, for example) with a rail mounted leaf 111 (preferably the fixed hinge leaf for mounting to a door frame 76, for example). Leaf 103 includes a combination of round holes 68, vertical slotted holes 69, and horizontal slotted holes 70 as shown in FIG. 23 and described above, and therefore allows horizontal and vertical adjustment of door 75 during the installation process. Leaf 103 is preferably attached to door 75 with screws 50 as shown in FIGS. 10 & 11 that include bushing 77. Leaf 103 may be covered with an ornamental security cover 78 as described above to conceal and prevent tampering with the screws.

With continuing reference to FIG. 24, leaf 111 is mounted to frame 76 via a longitudinally-extending rail which may be affixed to the frame via conventional fasteners 50 shown in FIG. 9. Leaf 111 and rail 112 are cooperatively configured so that the leaf may be secured to the rail 112 via an interlocking design including a lateral projection on one side of leaf 111 and a lateral recess on the mating side of rail 112, as taught in U.S. Pat. No. 6,732,409. The opposite side of rail 112 similarly contains a lateral recess, but is secured on that side to leaf 111 by a threaded fastener such as set screw 113 as shown. The rail allows leaf 111 to be vertically adjusted in position along the frame during the hinge installation process.

Leave 103 and 111 are pivotally connected together along their respective longitudinally-extending edges via geared segments 106, 107 and clamp 105, all as described above in conjunction with FIG. 23.

Figure 25:
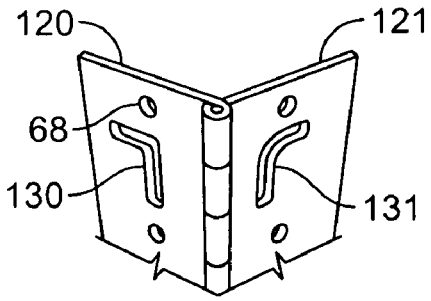
FIGS. 25-28 are perspective views of hinge members showing various possible mounting hole configurations providing vertical and horizontal adjustment of the hinge members.
Figure 26:
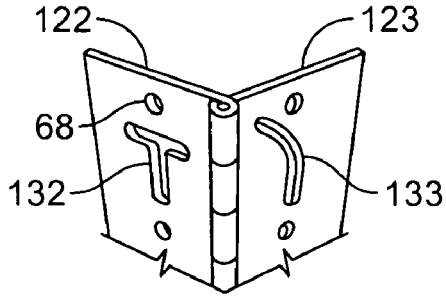

It will be appreciated that the number, size, orientation, and configuration of the elongated or slotted holes may be varied and combined, and therefore is not limited to the horizontal and vertical slots described heretofore. For example, FIGS. 25-28 show some possible alternative embodiments that are contemplated without limitation which may be used in numerous combinations thereof including with conventional round fastener holes. The left leaf 120 in FIG. 25 depicts an L-shaped slotted hole 130 which may be oriented in positions other than that shown. Conventional round holes 68 as described before may be combined with the slotted hole without limitation. The right leaf 121 depicts a possible arcuate slotted hole 131 extending upwards and outwards that may be used. A T-shaped slotted hole 132 is shown in left leaf 122 of FIG. 26. The left leaf 123 in FIG. 26 depicts an arcuate slotted hole 133 that extends upwards and inwards. Arcuate slotted holes 131 and 133 may be combined on a single leaf to provide positioning flexibility.

Figure 27:
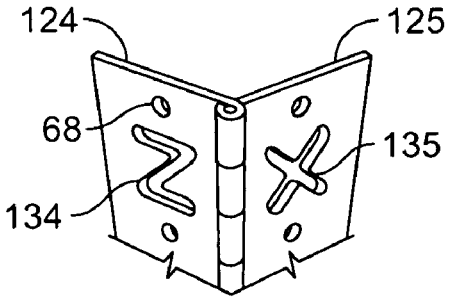
Figure 28:
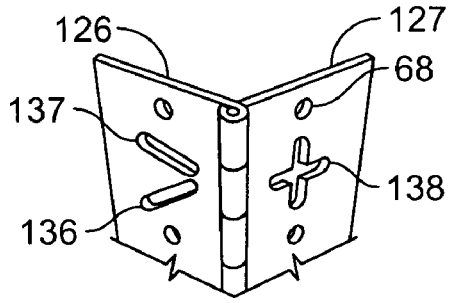

The left leaf 124 in FIG. 27 shows a Z-shaped slotted hole 134 and right leaf 125 shows an X-shaped slotted hole 135. The left leaf in FIG. 28 shows two angled slotted holes 136, 137 slanting in different directions. The right leaf 127 of FIG. 28 shows a cross-shaped slotted hole 138.

By way of the examples shown in FIGS. 25-28, it will be appreciated that numerous possible shapes and combinations are possible beyond the few illustrative examples shown. In addition, the combinations shown are not intended to be limiting in any way to those shown and are combined merely for the sake of brevity and efficiency in illustrating some possible slotted hole embodiments. Also as stated above, one leaf may simply contain all conventional round holes 68 while the other leaf contains the slotted holes.

The hinge members used in the preferred embodiment described herein may be fabricated of any suitable material commonly used in the art to manufacture hinges, including but not limited to steel, brass, aluminum, etc.

It will be appreciated that hinges formed according to the present invention may be used in a variety of applications where one object is intended to be pivotally connected to another object. The invention will be particular advantageous for, but is not limited to, continuous hinges including new and replacement commercial and industrial door installations where the use of continuous hinges offer many advantages. Such installations may include door-to-frame and door-to-door mounts. Moreover, the present invention may be used where more than two doors are to be pivotally connected together, and thus may involve three or more hinged objects with hinge members attached to some or all of these objects incorporating the present invention. Accordingly, the uses and applications of the present invention are not limited to those embodiments shown and described herein.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A method of aligning and mounting a vertically-hung door in a frame with a hinge including at least first and second leaves pivotally connected together, the method comprising:

(a) positioning a movable door in a stationary door frame;

(b) inserting at least one fastener into the frame through a mounting hole in the first leaf;

(c) inserting at least one fastener into the door through at least one vertical slot in the second leaf so that the fastener may slide in the slot;

(d) raising or lowering the door with respect to the frame;

(e) fixing the vertical position of the door with respect to the frame;

(f) removing the fastener from the vertical slot; and (g) adjusting laterally the position of the door with respect to the frame.

2. The method of claim 1, further comprising a step of (h) reinstalling the removed fastener in the vertical slot, whereby the horizontal position of the door with respect to the frame is fixed.

3. The method of claim 1, further comprising a step of (h) installing a fastener through at least one round hole in the second leaf, whereby the horizontal position of the door with respect to the frame is fixed.

4. The method of claim 1, wherein step (a) is immediately followed by a step comprising adjusting horizontally the position of the door in the frame and temporarily inserting shims or wedges between at least one side edge of the door and the frame, and further wherein step (e) is immediately followed by a step comprising removing the shims or wedges to allow step (g) to be performed.

5. The method of claim 1 wherein step (c) is replaced by a step comprising attaching movably the second leaf to the door by inserting at least one fastener into the door through at least one hole configured to allow at least vertical movement of the fastener in the hole.

6. The method of claim 1, wherein step (e) comprises inserting at least one fastener into the door through at least one hole configured to allow at least horizontal movement of the fastener in the hole, whereby the vertical position of the door is fixed.

7. The method of claim 1, wherein step (e) comprises inserting at least one fastener into the door through at least one horizontal slot in the second leaf such that the fastener may slide in the slot.

8. The method of claim 1, wherein step (b) comprises fixedly attaching the first leaf to the frame to prevent relative movement between the first leaf and frame.

9. A method of aligning and mounting hinged objects with a hinge including at least first and second hinge leaves pivotally connected together, the method comprising:

(a) positioning a first hinged object with respect to a second hinged object;

(b) attaching the first leaf to the first hinged object by inserting at least one fastener into the first hinged object through a mounting hole in the first leaf;

(c) attaching the second leaf to the second hinged object by inserting at least one fastener into the second hinged object through at least one vertical slot in the second leaf so that the fastener may slide in the slot;

(d) adjusting vertically the relative position of the first hinged object to the second hinged object by moving either or both hinged objects;

(e) fixing the vertical position of the second hinged object with respect to the first hinged object by inserting at least one fastener into the second hinged object through at least one horizontal slot in the second leaf such that the fastener may slide in the slot;

(f) removing the fastener from the vertical slot; and (g) adjusting laterally the relative positions of the first and second hinged objects to each other by moving the first or second hinged object.

10. The method of claim 9, further comprising a step of (h) reinstalling the removed fastener in the vertical slot, whereby the horizontal position of the door with respect to the frame is fixed.

11. The method of claim 9, further comprising a step of (h) installing a fastener through at least one round hole in the second leaf, whereby the horizontal position of the door with respect to the frame is fixed.

12. The method of claim 9, wherein step (c) is replaced by a step comprising attaching movably the second leaf to the second hinged object by inserting at least one fastener into the second hinged object through at least one hole in the second leaf configured to allow at least vertical movement of the fastener in the hole.

13. The method of claim 9, wherein step (e) is replaced by a step comprising attaching movably the second leaf to the second hinged object by inserting at least one fastener into the second hinged object through at least one hole in the second leaf configured to allow at least horizontal movement of the fastener in the hole, whereby the vertical position of the second hinged object with respect to the first hinged object is fixed.

14. The method of claim 9, wherein:

the mounting hole in the first leaf in step (b) is a horizontal slot;

step (e) is replaced by a step comprising inserting at least one fastener into the second hinged object through at least one round hole in the second leaf, whereby the vertical position of the second hinged object with respect to the first hinged object is fixed; and step (f) is replaced by a step comprising loosening the fastener in the horizontal slot in the first leaf so that the first leaf may horizontally move relative to the first hinged object to concomitantly allow the second hinged object to move laterally with respect to the first hinged object.

15. The method of claim 14, further comprising a step of (h) installing a fastener into the first hinged object through at least one vertical slot in the first leaf, whereby the horizontal position of the second hinged object with respect to the first hinged object is fixed.

16. The method of claim 14, further comprising a step of (h) installing a fastener into the first hinged object through at least one round hole in the first leaf, whereby the horizontal position of the second hinged object with respect to the first hinged object is fixed.

17. The method of claim 9, wherein the positioning step (a) includes resting the first hinged object or second hinged object on the floor.

18. The method of claim 9, wherein step (b) comprises fixedly attaching the first leaf to the first hinged object to prevent relative movement between the first leaf and first hinged object.

* * * * *